US006584815B2

(12) United States Patent
Bremicker

(10) Patent No.: US 6,584,815 B2
(45) Date of Patent: Jul. 1, 2003

(54) HOOP LOCK

(75) Inventor: Michael Bremicker, Rehe (DE)

(73) Assignee: Abus August Bremicker Söhne KG (DE)

( * ) Notice: Subject to any disclaimer, the term of this patent is extended or adjusted under 35 U.S.C. 154(b) by 0 days.

(21) Appl. No.: 09/870,238

(22) Filed: May 30, 2001

(65) Prior Publication Data

US 2002/0002850 A1 Jan. 10, 2002

(51) Int. Cl.[7] ..... E05B 67/24

(52) U.S. Cl. ..... 70/38 A; 70/39; 70/52; 70/386; 70/417

(58) Field of Search ..... 70/38 A, 39, 52, 70/38 R, 38 B, 38 C, 54–56, 386

(56) References Cited

U.S. PATENT DOCUMENTS

| | | | | |
|---|---|---|---|---|
| 1,511,057 A | * | 10/1924 | Freysinger | |
| 2,259,271 A | * | 10/1941 | Seay, Jr. | |
| 4,064,716 A | * | 12/1977 | Shwayder et al. | 70/38 A |
| 4,881,387 A | * | 11/1989 | Kortenbrede | 70/39 |
| 5,189,893 A | | 3/1993 | Kortenbrede | 70/38 A |
| 5,398,529 A | * | 3/1995 | Goldman et al. | 70/38 A |
| 5,400,624 A | * | 3/1995 | Shieh | 70/38 A |
| 5,417,092 A | * | 5/1995 | Iu | 70/38 A |
| 5,488,845 A | * | 2/1996 | Hsieh | 70/38 A |
| 5,640,861 A | * | 6/1997 | Chen | 70/38 A |
| 5,669,254 A | * | 9/1997 | Lee | 70/38 A |
| 5,694,796 A | * | 12/1997 | Couillard et al. | 70/39 |
| 5,931,030 A | * | 8/1999 | Chen | 70/38 A |
| 5,987,940 A | * | 11/1999 | Chang | 70/38 A |

FOREIGN PATENT DOCUMENTS

| | | | | |
|---|---|---|---|---|
| DE | 512 624 | | 11/1930 | |
| DE | 2736984 | * | 3/1979 | 70/39 |
| DE | 43 22 989 A1 | | 1/1995 | |
| EP | 86381 | * | 8/1983 | 70/38 A |
| EP | 0 641 909 A | | 3/1995 | |

* cited by examiner

*Primary Examiner*—Lloyd A. Gail
(74) *Attorney, Agent, or Firm*—Gifford, Krass, Groh, Sprinkle, Anderson & Citkowski, P.C.

(57) ABSTRACT

The invention elates to a hoop lock comprising a lock body and a hoop. The hoop can be coupled a its hoop ends to the lock body and latched thereto in the coupled state wherein two force cells spatially separated from one another are arranged in the lock body for the reception of the hoop ends. Each force cell is associated with a latching arrangement for a hoop end which is adjustable between a latched state and a released state and which can be actuated via a locking unit. At least one latching arrangement has a bolt element whose side remote from the inserted hoop end is supported at the force cell in the latched state.

26 Claims, 9 Drawing Sheets

HOOP LOCK

FIELD OF THE INVENTION

The invention relates to a hoop lock comprising a lock body and a hoop which can be coupled to the lock body at its hoop ends and which can be latched thereto in the coupled state.

BACKGROUND OF THE INVENTION

There is a problem with such locks in that the locking mechanism can be deformed or displaced by blows onto the lock body in the latched state such that the hoop can also be pulled out of the lock body in the latched state. While actions to strengthen the lock body could result in an improved protection of the locking mechanism, these would, however, disadvantageously increase the weight of the lock.

SUMMARY OF THE INVENTION

It is the object of the invention to provide a hoop lock of the kind initially mentioned which is secure against being broken open while having the lowest possible weight.

This object is satisfied in accordance with the invention in that two force cells, which are spatially separated from one another, are arranged for the reception of the hoop ends and in that each force cell is associated with a latching arrangement for a hoop end which can be adjusted between a latched state and a released state and which can be actuated via a locking unit, with at least one latching arrangement comprising a bolt element whose side remote from the inserted hoop end is supported at the force cell in the latched state.

The support in accordance with the invention of the bolt element at the force cell prevents the bolt element from being moved out of engagement with the hoop end in the latched state. The support of the bolt element at the force cell can take place either directly or indirectly via an additional, separate component. Deformations of the bolt actuations due to blows onto the lock body do not impair the latched state since such deformations have no effect on the support of the bolt element at the force cell. Break-open forces applied from the outside which attempt to move the bolt element out of its latched position in the latched state are absorbed by the force cell in accordance with the invention and rendered ineffective in this way.

It is particularly preferred if, in at least one force cell, both the side of the inserted hoop end remote from the bolt element and the bolt element are supported at the same component of the force cell. A particularly stable force cell is provided in this way.

At least one force cell can have walls formed in particular as drill protection and/or blow protection, which at least partly bound a protected space for at least the hoop end and the bolt element, with the force cell serving not only the absorption of forces acting on the hoop end and the bolt element, but also additionally increasing the resistance to other external influences such as attempts to cancel the latching engagement between hoop end and bolt element by drilling it open.

In a particularly preferred practical embodiment of the invention, at least one force cell has a U section whose open side faces the other force cell. The U section can be arranged such that the hoop end is inserted at the side between the limbs of the U and consequently extends perpendicular to the limbs of the U in the inserted state. It is preferred if a side of the hoop end remote from the bolt element is supported at the U base connecting the U limbs and the bolt element is supported at at least one U limb. The hoop end and the bolt element are in this way surrounded on three sides by section walls and protected against external influences. This embodiment in particular provides an advantageous protection of the hoop end at the end face of the lock body by the U base of the U section.

The latching arrangement can be made in multiple parts and have, in addition to the bolt element, a positioning element which can be actuated via the locking unit and via which the bolt element is indirectly supported at the force cell. It is also alternatively possible to provide a one-part latching arrangement in the form of a bolt element supported directly at the force cell which both cooperates with the hoop end to be inserted and can be actuated via the locking unit.

In a preferred embodiment of a multiple part latching arrangement, the positioning element is formed as a pivoted lever comprising an actuating arm and a support arm. The pivoted lever can be pivoted via the actuating arm by means of the locking unit between a latched position in which the bolt element is supported at the force cell via the support arm, and is thus secured in a latched position by the support arm, and a released position in which it is possible to move the latching element out of its latched position.

A pivotal support of the pivoted lever at the force cell can take place, for example, by the pivoted lever extending between opposite walls of the force cell and being supported at apertures in the walls forming support regions.

It is particularly preferred if the latching arrangement is made self-locking. This can be done, for example, by dead travel and/or play of the positioning element. It can be achieved with the self-locking that the securing effect of the positioning element is not weakened or cancelled in typical break-open attempts such as blows onto the lock body, but is rather strengthened.

A preferred possibility for implementation of such a self-locking of the latching arrangement consists of supporting the positioning element such that it can be moved beyond a maximum latched position which can be set by the locking unit, with the bolt element being supported and/or secured at the force cell in every additional position via the positioning element. In this way, the inertia of the positioning element can be utilized which, in the event of blows onto the lock body, results in a relative movement between the force cell which moves along with it and the positioning element.

It is preferred if the positioning element can be brought into engagement with the bolt element by such a relative movement and can, in particular, be clamped or wedged between the bolt element and the force cell.

Due to the self-locking effect in accordance with the invention, exactly the opposite effect of that intended in such break-open attempts is consequently achieved by blows onto the lock body.

In a further preferred embodiment of the invention, the bolt element can be moved out of a latched position in the released state by pulling the hoop end out of the force cell. It is preferred if the bolt element is pre-stressed into the latched position by a spring member arranged in or projecting into the force cell. The restoring force of the spring member is preferably set such that the inserted hoop is held at the lock body secure against falling out.

Further preferred embodiments of the invention are also given in the dependent claims, the description and the drawing.

BRIEF DESCRIPTION OF THE DRAWINGS

The invention is described below by way of example with reference to the drawing, in which are shown.

DETAILED DESCRIPTION OF A PREFERRED EMBODIMENT OF THE INVENTION

Figure 1:
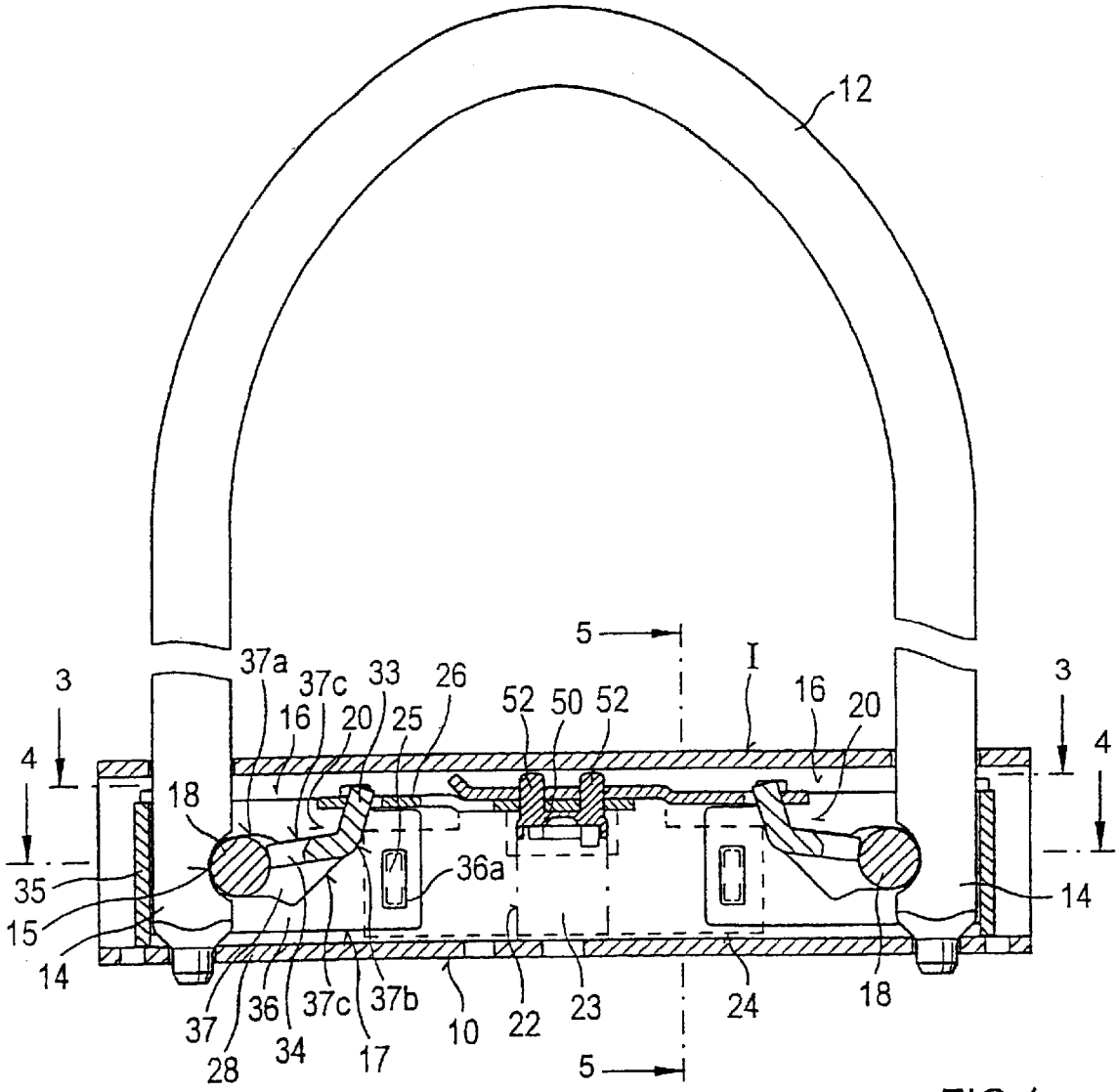
FIG. 1 a cut-open side view of a hoop lock in accordance with an embodiment of the invention.

FIG. 1 shows the hoop lock in accordance with the invention, which comprises a lock body 10 and a hoop 12, in a latched state in which the hoop ends 14 of the hoop 12 are inserted into force cells 16 of the lock body 10 which are described in more detail in the following and which are each arranged in the region of a tube end spatially separated from one another in a tubular housing 28.

A latching arrangement, which is arranged in the force cell 16 and which comprises a bolt element 18 in the shape of a roller and a positioning element in the form of a pivoted lever 20, is provided for the latching of each hoop end 14. In the latched state, the bolt 18 is located in a latched position in which it engages in a bolt receiver 15 of the hoop end 14 matched to its shape and is supported at the force cell 16 by a support arm 34 of the pivoted lever 20. The bolt element 18 is secured in the latched position in this way. An actuating arm 33 of the pivoted lever 20, which forms an angle of more than 90° with the support arm 34 and which projects out of the force cell 16, is coupled to the one end region of a linkage 26 which is connected to an actuating member 50 at its opposite end region. The linkage and the actuating member 50 form an actuating assembly via which the two pivoted levers 20 can be pivoted between the latched position shown and a released position by means of a lock cylinder 23 of a locking unit 22 indicated only schematically.

The actuating member 50 is rotationally fixedly connected to the lock cylinder 23 so that the linkage 26 can be adjusted along its longitudinal axis via actuating pins 52 of the actuating member 50 by turning the lock cylinder 23 by means of an inserted key (not shown).

The constructionally identical force cells 16 each comprise a U-shaped section 17 made of hardened metal with section walls 36 which form the limbs of the U and extend parallel to one another. The open sides of the U sections 17 face one another and are arranged so that the hoop ends 14 of the hoop 12 can be inserted between the section walls 36.

The U sections 17 are each positioned in the lock body 10 relative to the insertion openings for the hoop 12 formed in the lock body 10 such that the side of the hoop end 14 remote from the latching arrangement 18, 20 is supported at the section wall forming the U base 35.

Apertures 37 are formed in the section walls 36 at whose bounding edges the bolt element 18 and the positioning element 20, which extend between the section walls 36, are supported.

The apertures 37 comprise for this purpose one reception region 37*a* each for the roller 18 which allows a movement perpendicular to the inserted hoop end 14 and thus in the longitudinal direction of the section walls 36. The pivoted lever 20 is pivoted at support regions 37*b* of the apertures 37 and simultaneously supported such that a translatory movement of the pivoted lever 20 perpendicular to the inserted hoop end 14 is not possible.

The pivot region for the pivoted lever 20 is bounded by the shape of the apertures 37 such that the bounding edges of the apertures 37 form abutment surfaces 37*c* for the support arm 34 of the pivoted lever 20.

The section walls 36 are provided in the region of their free ends with recesses 36*a* into which there engage protrusions 25 of a reception housing 24 for the locking unit 22 shown only schematically. The U sections 17 are in this way fastened secure against removal at the reception housing 24 and coupled to one another via the reception housing 24. The U sections 17 can be latched to the reception housing 24 by being pushed onto the projections 25.

Figure 2:
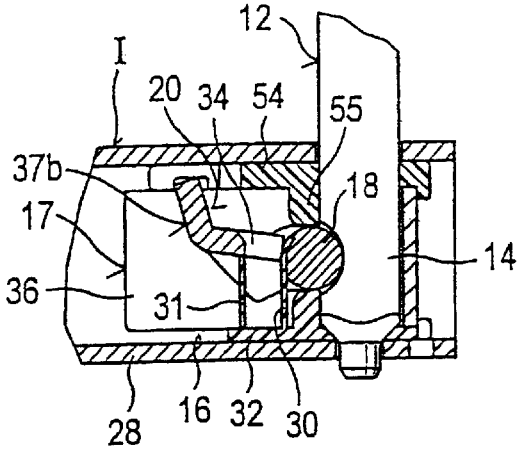
FIG. 2 the region of a force cell of the hoop lock of FIG. 1 with additional components not shown in FIG. 1.

FIG. 2 shows additional components not shown in FIG. 1 which are arranged in the region of the force cells 16. The components in question are, on the one hand, a spring arrangement of plastic which comprises a plate-like carrier 32 which extends perpendicular to the section walls 36, which is arranged outside the U section 17 and which adjoins the side edges of the U section 17. The carrier 32 is connected in one piece to perpendicularly protruding spring tongues 30, 31 which project into the force cell 16 between the section walls 36.

A spring tongue 30 whose free end regionally engages around the roller 18 serves to hold the roller 18 in its latched position even when the pivoted lever 20 is pivoted into the released position in which the roller 18 is not secured by the support arm 34 and thus is not supported at the U section 17 via the pivoted lever 20.

The bolt element 18 can be moved out of its latched position in this released state by pulling the hoop end 14 out of the force cell 16 against the resetting force of the spring tongue 30 perpendicular to the inserted hoop end 14. The spring tongue 30 is matched to the hoop 12 such that its resetting force is sufficiently great in order to prevent the hoop 12 from falling out due to its own weight alone; the inserted hoop 12 is therefore held secure against falling out at the lock body 10 in the released state by the bolt elements 18 pre-stressed into their latched position.

The other spring tongue 31 attached to the carrier 32 serves as a holding member for the pivoted lever 20. The holding member holds the pivoted lever 20 in the support regions 37*b* of the section walls 36. As a result, only pivotal movements of the positioning element 20 are possible, while translatory movements are prevented by the holding member 31.

FIG. 2 further shows a cushion, buffer or damper member 54 made of plastic which is arranged on the inner side I of the lock body 10 facing the hoop 12 between the housing 28 of the lock body 10 and the U section 17.

A lug 55 of th damper member 54 projects into the force cell 16 up to the bolt element 18. The damper elements 54 arranged at both force cells 16 form an additional protection against breaking open which cushions blows onto the housing 28 of the lock body 10. This damping is the subject of a German patent application of the applicant having Serial No.: DE 100 26 701.7 submitted on May 30, 2000 and whose disclosed content is herewith included in the present application by reference.

The carrier 32 arranged at the outside of the lock body 10 between its housing 28 and the U section 17 likewise provides such blow protection.

On the one hand, great external forces can be absorbed in a closed system by the force cells 16 in accordance with the invention. On the other hand, the force cells 16 allow a geometrical arrangement of the latching arrangements or the bolt elements such that external forces are distributed more uniformly and force or strain peaks are avoided. Distribution of external force takes place in a manner of speaking both spatially, namely by an enlarging of the expansion region, and temporally, namely by a reduction in mass accelerations. The above-mentioned cushions, buffers or dampers 54 also work in this sense.

Figure 3:
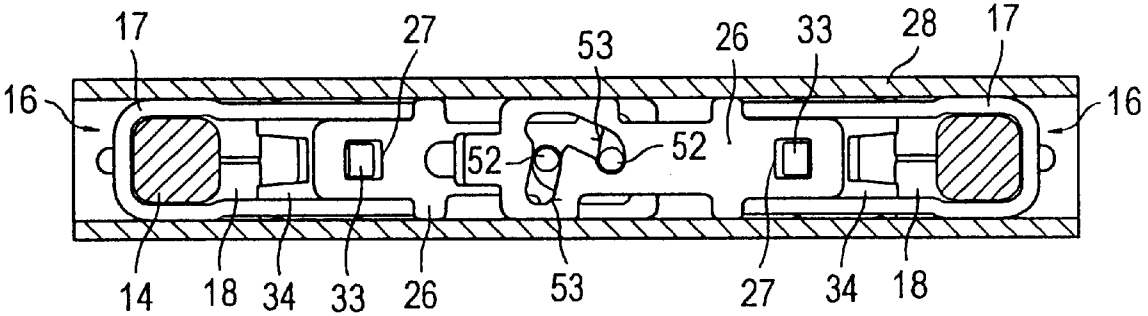
FIG. 3 a section through the hoop lock of FIG. 1 along the lines 3—3.

It can in particular be seen from FIG. 3 that the support arm 34 of the positioning element 20 is formed in a fork shape so that the spring member 30 and the holding member 31 can project through the fork arms of the support arm 34.

Moreover, recesses 27 are shown in FIG. 3 in the end regions of the linkages 26 into which the respective free end of the actuating arm 33 of the pivoted lever 20 engages. The actuating arms 33 are arranged in the recesses 27 with play. This play in each case allows a self-locking function of the latching arrangement 18, 20 which is explained in more detail in the following in connection with FIG. 8.

Guide openings 53 are formed in regions of the linkages on top of one another which cooperate with the actuating pins 52 of the actuating member 50 which can be rotated via the lock cylinder 23 of the locking unit 22. One of the two arms of each guide opening 53 serves for the reception of the actuating pin 52 displacing the relevant linkage 26, while the other arm allows an unimpeded movement of the actuating pin 52 serving the displacement of the other linkage 26. In the embodiment shown, the right hand actuating pin 52 in FIG. 3 serves the movement of the lower linkage 26, while the upper linkage 26 is moved via the left hand actuating pin 52.

Figure 4:
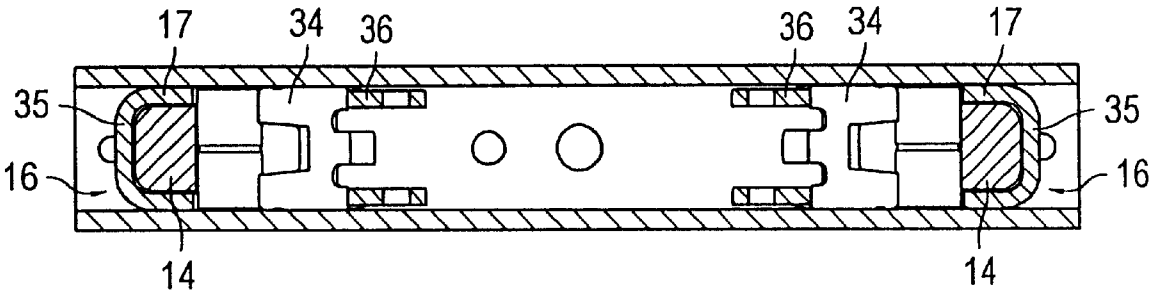
FIG. 4 a section through the hoop lock of FIG. 1 along the line 4—4.

It can be seen in particular from FIG. 4 that there is no, or at most only little, play present at each of the two force cells 16 between the U base 35 of the U section and the hoop end 14, between the hoop end 14 and the roller 18, between the roller 18 and the fork-like support arm 34 of the pivoted lever 20 and between the pivoted lever 20 and the section walls 36.

In the latched state shown, the hoop end 14 is thus supported directly, and the bolt element 18 indirectly via the positioning element 20, at opposing sides of the same component of the force cell 16, namely the U section 17. Movements of the bolt element 18 are not possible in this latched position supported and secured by the positioning element 20. This latched state cannot be effected by attempts to break open, such as blows onto the lock body 10, either since deformations of the linkages 26 possibly caused thereby do not alter the immobility of the bolt elements 18.

Figure 5:
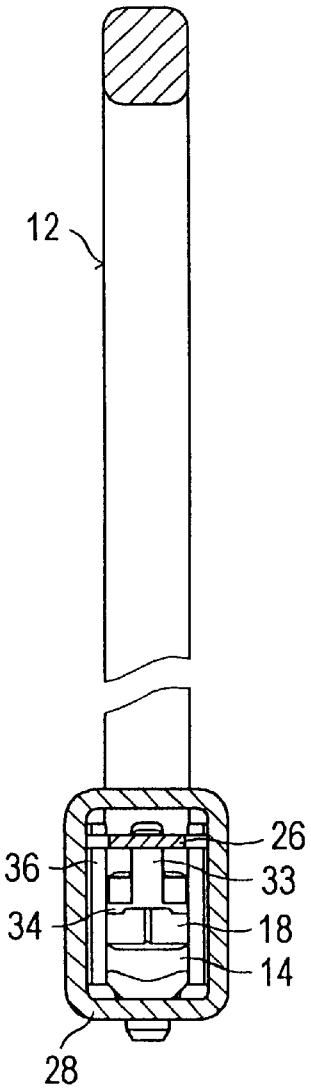
FIG. 5 a section through the hoop lock of FIG. 1 along the line 5—5.

FIG. 5 shows in particular the actuating arm 33 of the pivoted lever 20 projecting through the recess 27 of the linkage 26.

Figure 6:
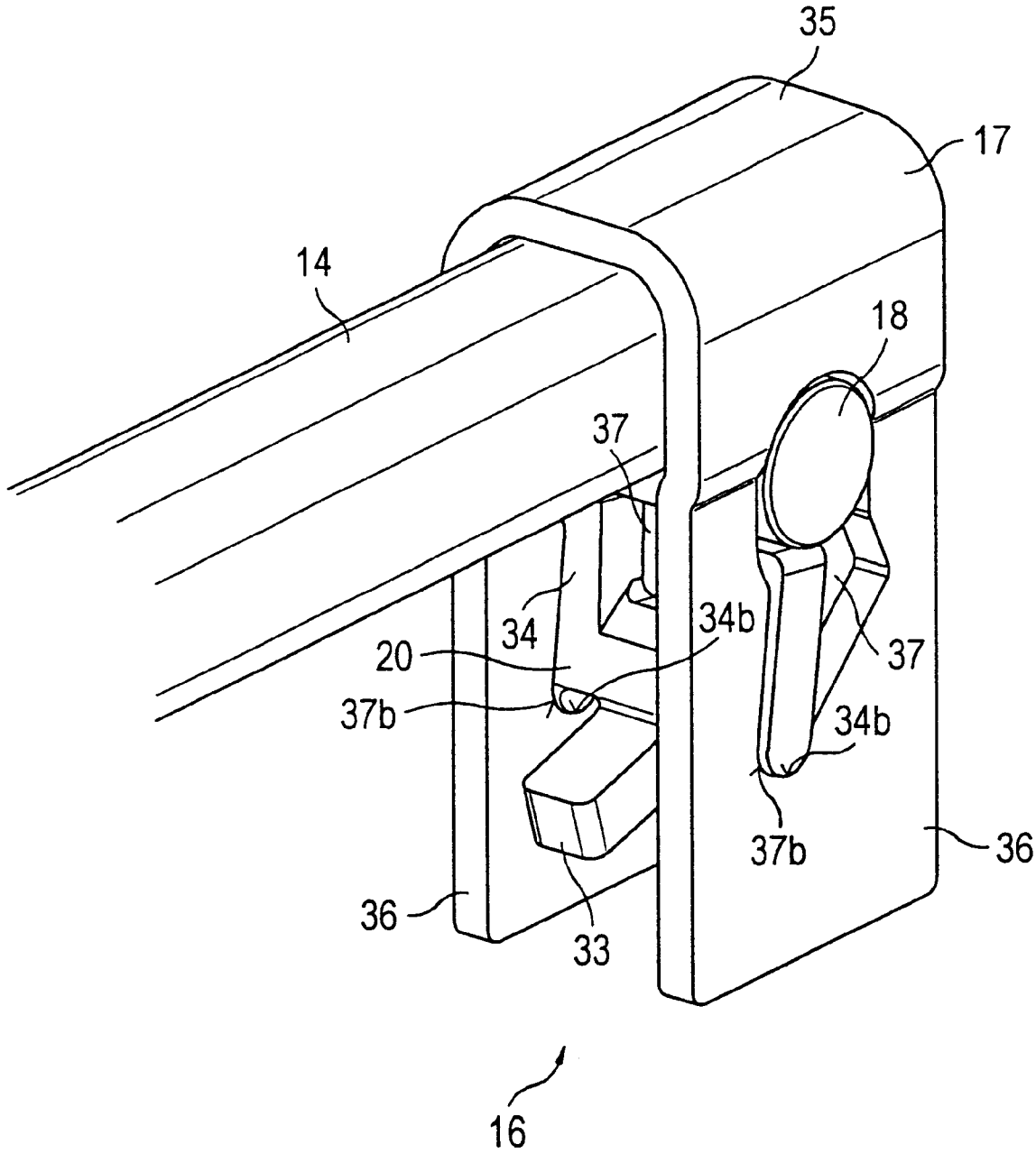
FIG. 6 a perspective part view, enlarged with respect to FIG. 1, in the region of a force cell.

In particular the support of the pivoted lever 20 in the support regions 37*b* of the apertures 37 formed in the section walls 36 can be seen from the perspective view of FIG. 6. For this purpose, the fork arms of the fork-like support arm 34 are rounded at their end remote from the bolt element 18 so that they form support surfaces 34*b* with which the pivoted lever sits in the correspondingly shaped support regions 37*b* of the sections walls 36 or the apertures 37.

Figure 7:
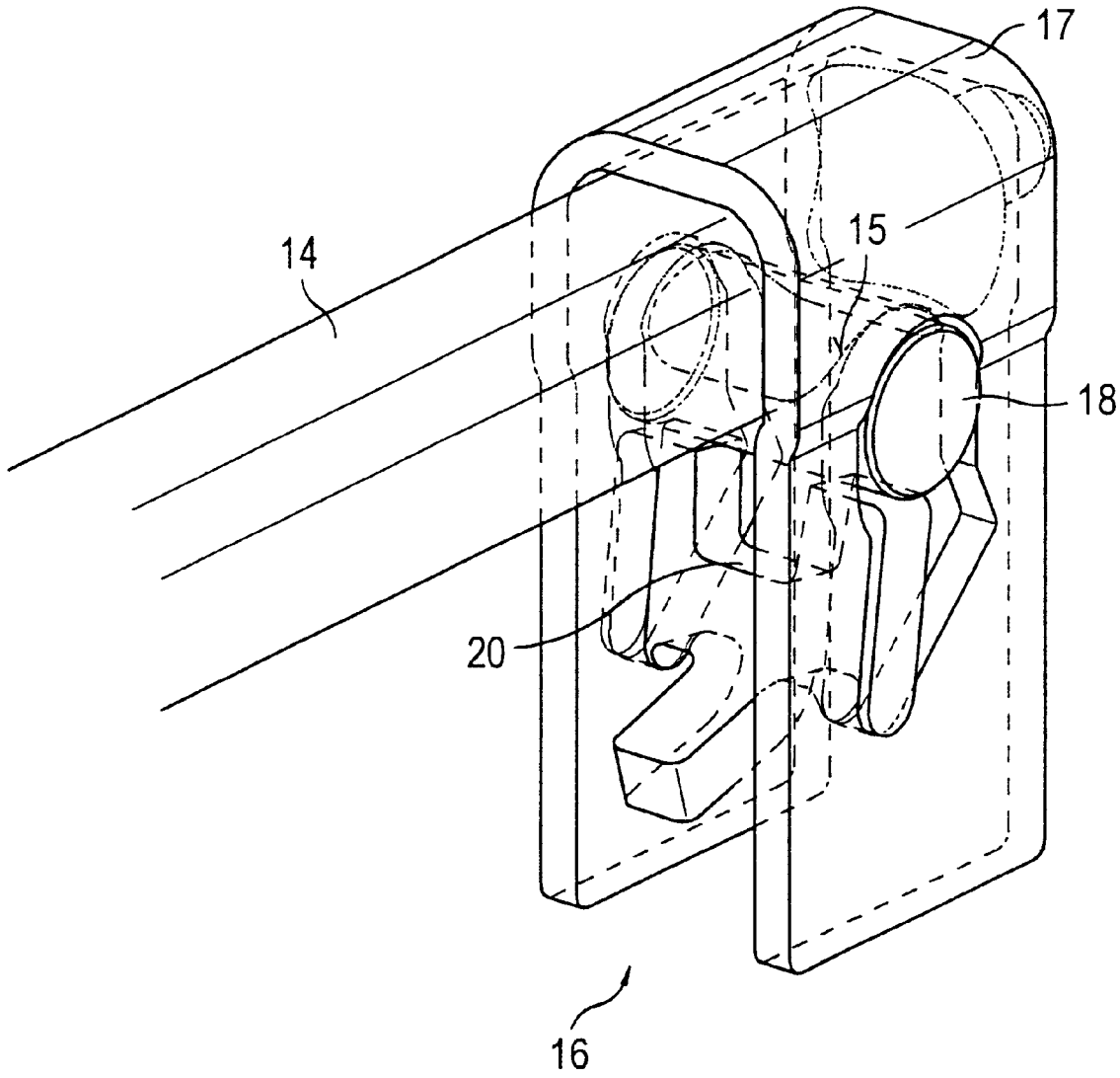
FIG. 7 the view of FIG. 6 in a phantom representation.

In particular the bolt reception 15 of the hoop end 14 shaped in accordance with the outer contour of the roller-shaped bolt element 18 can be seen in FIG. 7.

Figure 8:
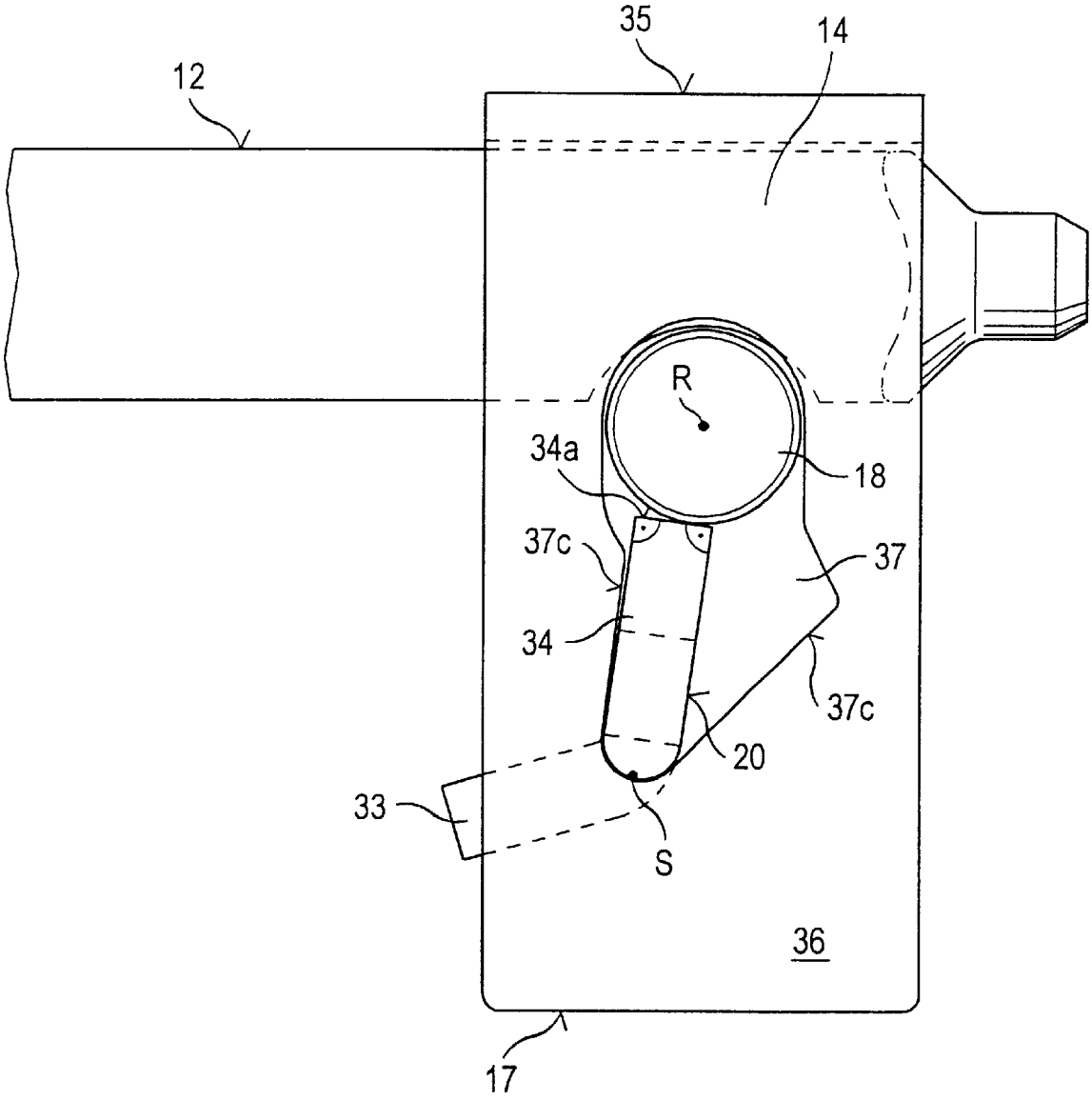
FIG. 8 the region shown in FIG. 6 in a side view.

The side view of FIG. 8 shows a latched state in which the pivoted lever is located in a latched position which can be set to a maximum via the locking unit 22, i.e. the pivoted lever 20 can not be turned further in an anti-clockwise direction (with respect to FIG. 8) by means of a key inserted into the lock cylinder 23, even though a small intermediate space is present between the support arm 34 and the corresponding abutment surface 37*c* of the apertures 37 which would permit a further pivotal movement of the pivoted lever 20 in an anti-clockwise direction.

However, the actuating arrangement comprising the linkage 26 does not hinder the pivoted lever 20 from such a further movement beyond the maximum latched position which can be set, since the actuating arm 33 of the pivoted lever 20 is arranged in the recess 27 of the linkage 26 with play (cf. in particular FIG. 3). There is thus a dead travel or play of the pivoted lever 20 located in the maximum latched position which can be set, whereby a self-locking function of the latching arrangement 18, 20 is realized.

The inertia of the pivoted lever 20 results in the pivoted lever 20 being further pivoted in a counter-clockwise direction relative to the U section 17 until it adjoins the abutment surface 37*c* in the event of blows onto the inside I of the lock body 10.

This further pivotal movement of the pivoted lever 20 is associated with a stroke of a part of the support surface 34*a* of the pivoted lever 20 facing the bolt element 18 in the direction of the hoop end 14, whereby the bolt element 18 is pressed against the hoop end 14. This stroke can be absorbed by a small amount of play, for example between the U base 35 of the U section 17 and the hoop end 14.

The size of the stroke depends in particular on the relative arrangement between the bolt element 18 and the pivoted lever 20 and on the course of the support surface 34*a*.

In the embodiment shown, the support surface 34*a* extending perpendicular to the sides of the support arm 34 in the maximum latched position which can be set in accordance with FIG. 8 forms an angle other than 90° with a line connecting the pivot axis S of the pivoted lever 20 and the center axis R of the bolt element 18.

Blows onto the inner side I of the lock body 10 thus result in a self-locking of the latching arrangement 18, 20 which results in a wedging of the support arm 34 of the pivoted lever 20 between the bolt element 18 and the U section 17.

The support arm 34 of the pivoted lever 20 can also be further removed from the abutment surface 37*c* than shown in FIG. 8 in the maximum latched position which can be set. Furthermore, the support surface 34*a* does not need to contact the bolt element 18 in the maximum latched position which can be set. The relative arrangement between the bolt element 18 and the pivoted lever 20 takes place in any case such that the bolt element 18 is secured in its latched position by the support arm 34 of the pivoted lever 20 not only in the maximum latched position which can be set, but also in any position of the pivoted lever 20 beyond this.

Figure 9:
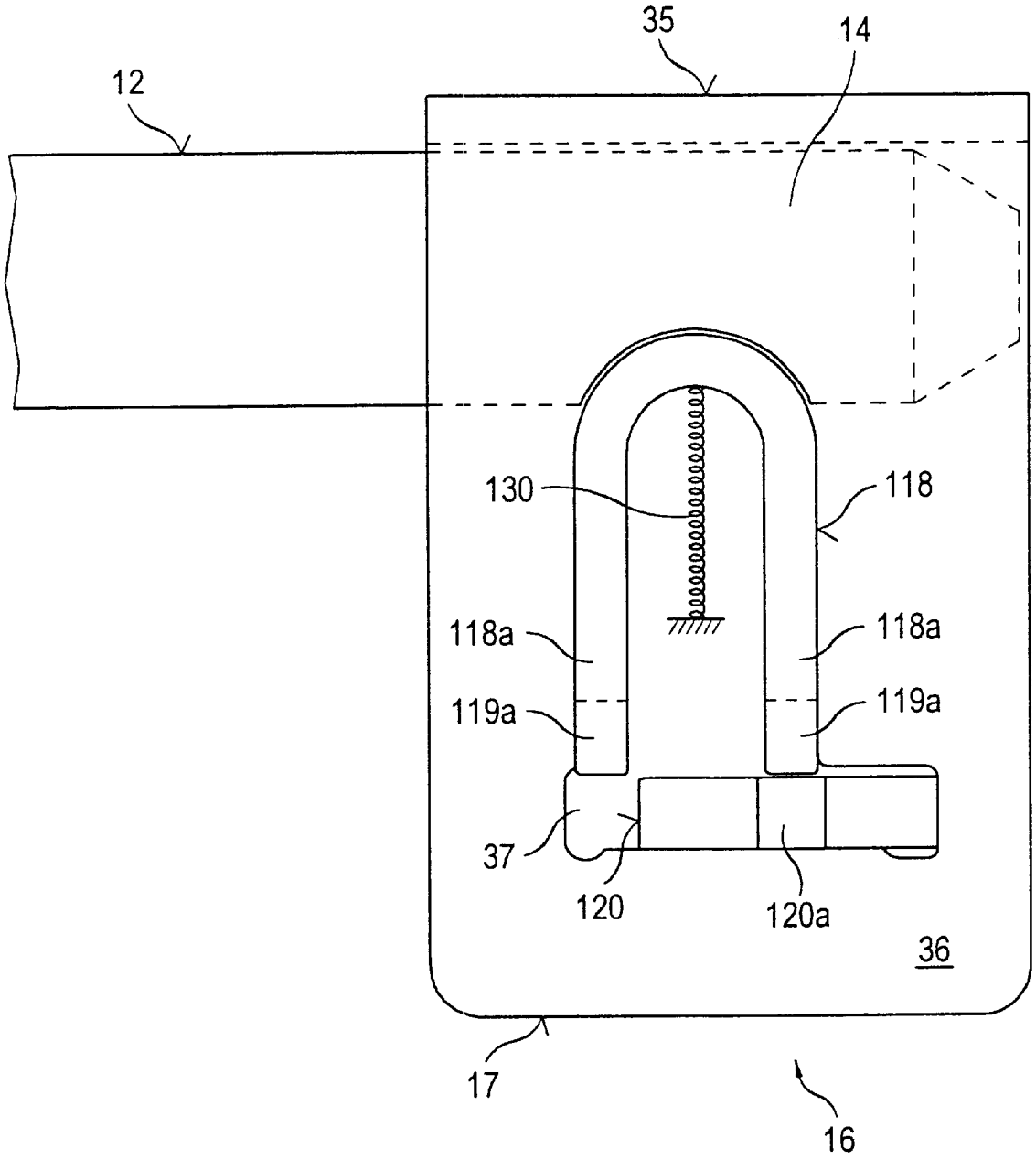
FIG. 9 the region of a force cell of a hoop lock in accordance with a further embodiment of the invention in a side view.
Figure 10:
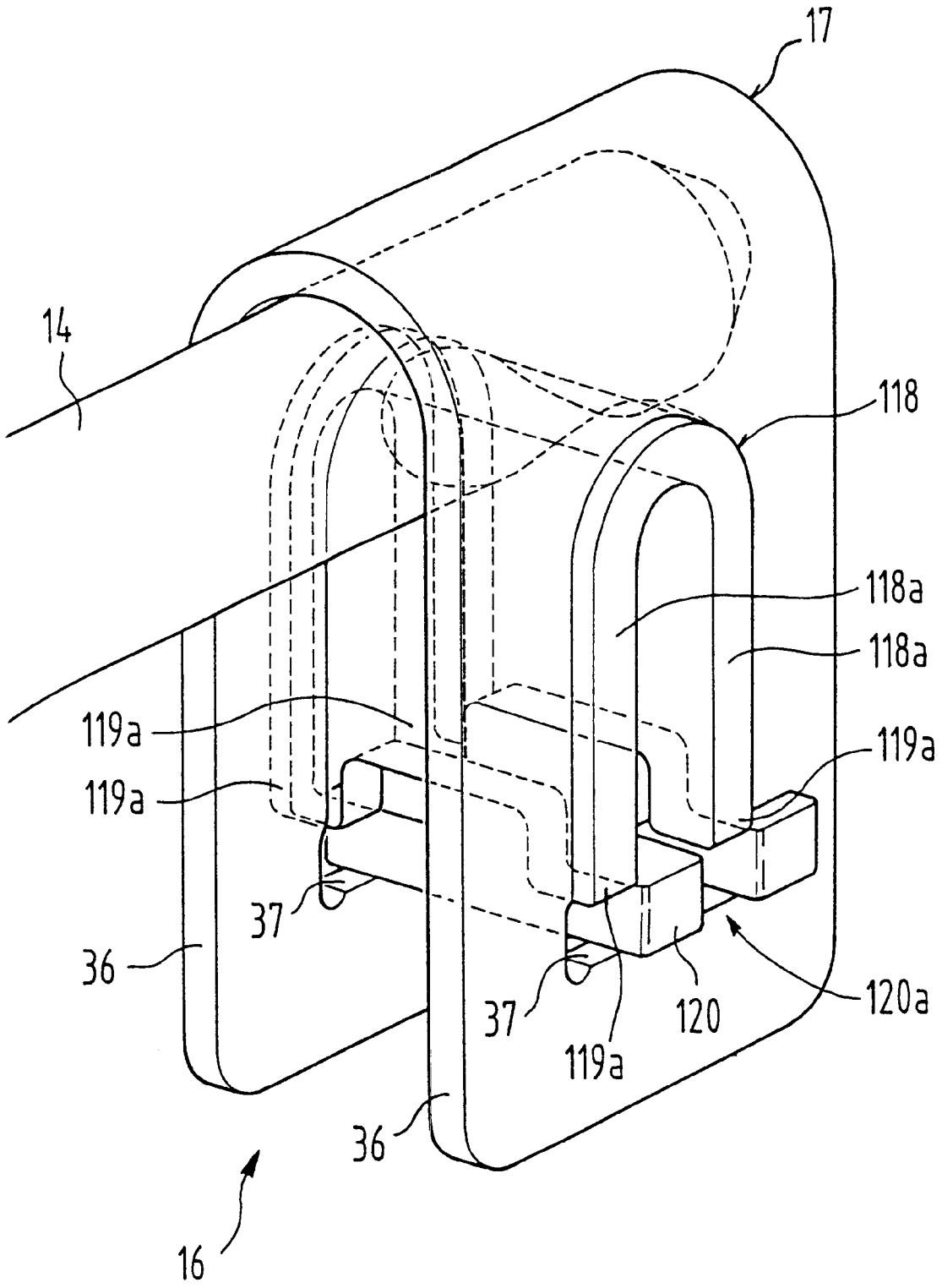
FIG. 10 a perspective view of the region of FIG. 9 in a phantom representation.

FIGS. 9 and 10 show a further embodiment of the invention in which the bolt element 118 is bent in a U-shaped manner and extends between the section walls 36 of the U section 17. The bolt element 118 is pre-stressed in its shown latched position by a spring member 130 only indicated in FIG. 9 which is arranged between the U limbs 118*a* of the bolt element 118.

A positioning element 120 can be displaced perpendicular to the U limbs 118*a* of the bolt element 118 via the locking unit of the lock, whereby it is guided in the apertures 37 of the section walls 36 of the U section 17.

The U limbs 118*a* of the bolt element 18 are each provided at their free ends with extensions arranged at the side which form engaging sections 119*a*.

A released state of the latching arrangement 118, 120 is shown in FIGS. 9 and 10 in which the extensions 119*a* of the bolt element 118 can be moved past the positioning element 120 or through recesses 120*a* of the positioning element 120.

The bolt element 118 can thus be moved out of its latched position in the released state by pulling the hoop end 14 out of the force cell 16 against the resetting force of the spring member 130.

The bolt element 118 is supported at the U section 17 in its latched position and thus secured in its latched position via the positioning element 120 by a displacement of the positioning element 120 via the locking unit and by a suitable actuating arrangement interposed between the locking unit and the positioning element 120.

Figure 11:
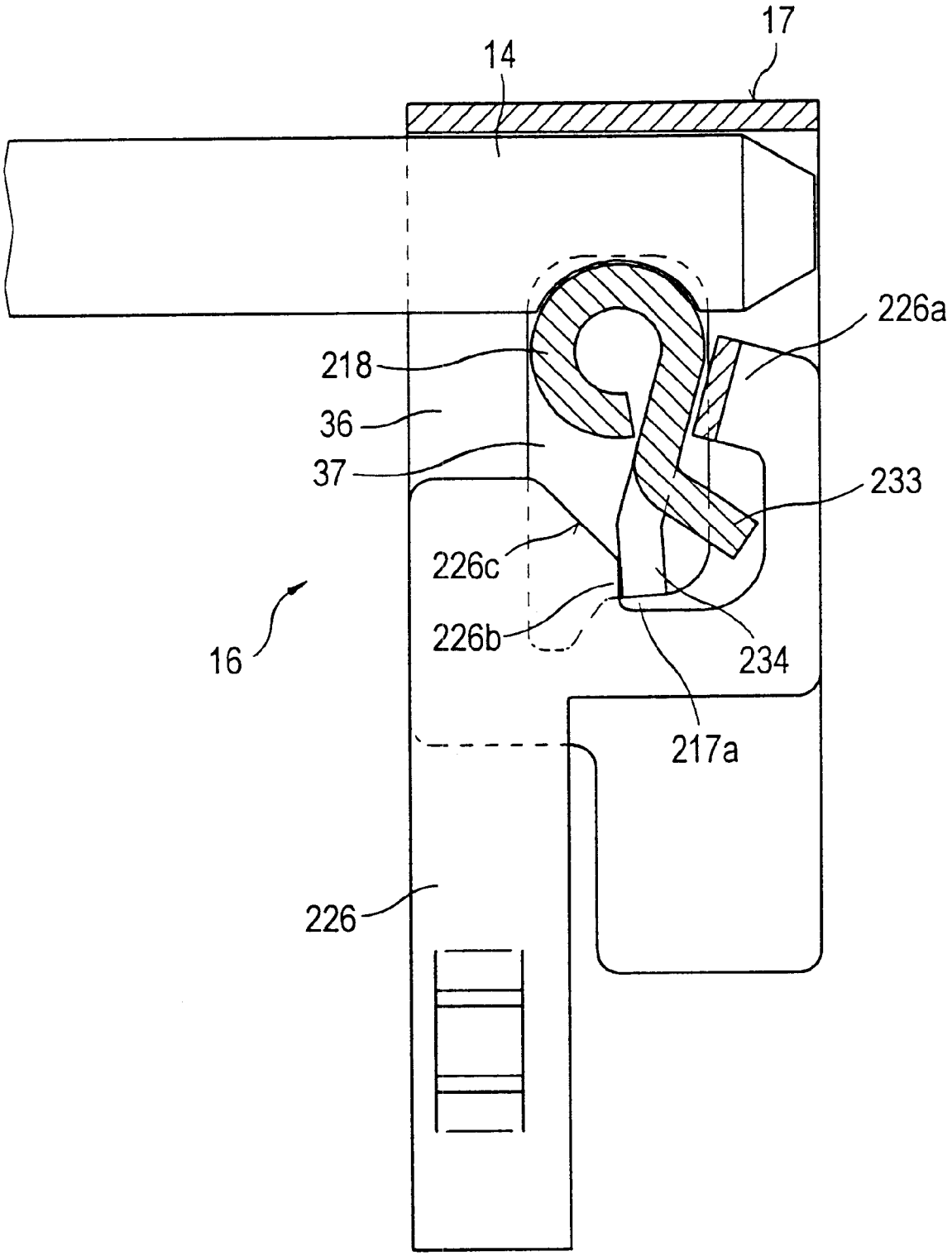
FIG. 11 the region of a force cell of a hoop lock in accordance with a further embodiment of the invention in a side view.
Figure 12:
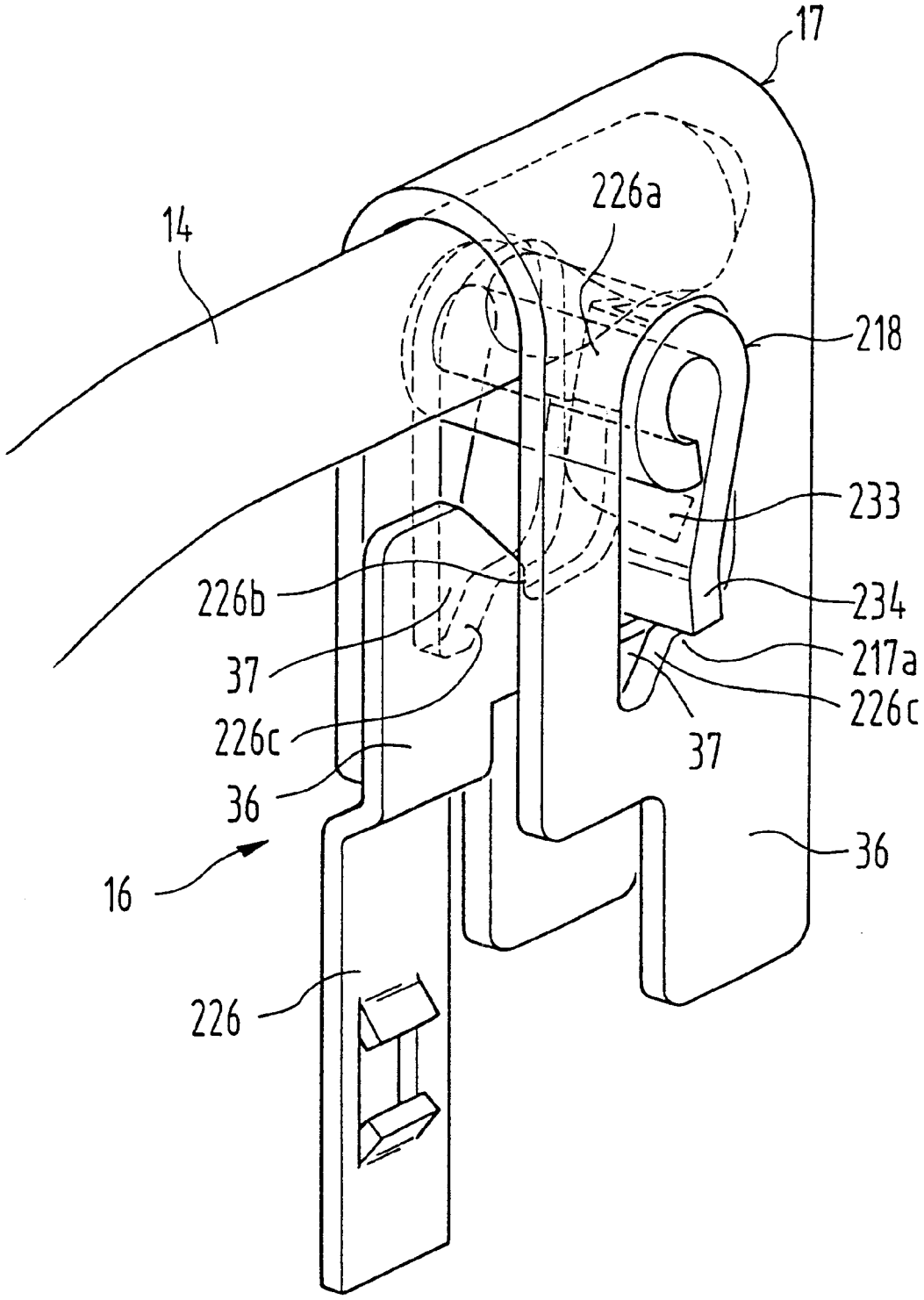
FIG. 12 a perspective representation of the region of FIG. 11 in a phantom representation.

FIGS. 11 and 12 show a further embodiment of the invention in which the latching arrangement is made in one part and comprises a bolt element 218 which cooperates with the hoop end 14 at a side bent in accordance with the bolt reception of the hoop end 14 and which has an actuating arm 233 and a fork-like support arm 234 at its sides remote from the inserted hoop end 14. The actuating arm 233 disposed between the fork arms of the support arms 234 is bent with respect to the support arm 234 such that a hook-like actuating section 226*a* of an actuating member 226, which is perpendicularly adjustable relative to the inserted hoop end 14 via the locking unit of the lock, can pivot the bolt element 218 in a clockwise direction (with respect to FIG. 11) from its shown latched position into a released position via the actuating arm 233.

Whereas the bolt element 218 is supported in the latched position via its support arm 234 at support sections 217*a* which bound apertures 37 in the section walls 36 of the U section 17, the bolt element 218 can, in the released state which can be set by pivoting, be moved out of its latched position, past the support sections 217*a* and, with its support arm 234, into a region of the apertures 37 adjacent to the support section 217*a*.

The bolt element 218 is secured in the latched position via its support arm 234 in the latched state by a securing section 226*b* of the actuating member 226.

The pivot movement of the bolt element 218 from the latched position into the released position can take place against the resetting force of a spring member. Furthermore, a spring member can be provided which pretensions the bolt element 218 into engagement with the hoop end 14 and against whose resetting force the bolt element 218 can be moved out of the latched position into the unlatched position by pulling the hoop end 14 out of the force cell 16.

A slope 226*c* of the actuating member 226 bounding the securing section 226*b* ensures that the bolt element 218 is reliably moved out of the unlatched position back into the latched position via its support arm 234 when the actuating member 226 is adjusted in the direction of the hoop end 14 via the locking unit.

Reference Numeral List

10 lock body
12 hoop
14 hoop end
15 bolt receiver
16 force cell
17, 117, 217 U section
  217*a* support section
18, 118, 218 bolt element
  118*a* U limb
  119*a* engaging section
20, 120 positioning element
  120*a* recess
22 locking unit
23 lock cylinder
24 reception housing
25 projection
26, 226 actuating member, linkage
  226*a* actuating section
  226*b* securing section
  226*c* oblique surface
27 recess
28 housing of the lock body
30, 130 spring member
31 holding member
32 carrier
33, 233 actuating arm
34, 234 support arm
  34*a* support surface
  34*b* bearing surface
35 U base
36, 136, 236 section wall
  36*a* recess
37, 137, 237 aperture
  37*a* reception region
37*b* support region
37*c* abutment surface
50 actuating member
52 actuating pin
53 guide aperture
54 damping element
55 lug
S pivot axis of the positioning element
R center axis of the bolt element
I inner side of the lock body

What is claimed is:

1. A hoop lock comprising:

a lock body (10) and a hoop (12) which can be coupled at its hoop ends (14) and which can be latched thereto in a coupled state, wherein two force cells (16) being spatially separated from one another are arranged in the lock body (10) for the reception of the hoop ends (14) and each force cell (16) is associated with a latching arrangement (18, 20; 118, 120; 218) for a hoop end (14) which is adjustable between a latched state and a released state and which can be actuate via a locking unit (22), and wherein at least one latching arrangement has a bolt element (18; 118; 218) that is separate from said at least one latching arrangement, said bolt element being movably held at the force cell wherein the force cell is spatially separated from the locking unit, said bolt element being operative to be actuated by an actuating member extending between the locking unit and the latching arrangement, aid bolt element being supported at the force cell in the latched state on a side that is remote from the inserted hoop end (14) and that faces in the release direction, and wherein at least one force cell has a U section whose open side faces the other force cell, and wherein the inserted hoop end is supported at a U base of the U section and the bolt element is supported at at least one U limb of the U section.

2. A hoop lock in accordance with claim 1, characterized in that in at least one force cell (16), both the side of the inserted hoop end (14) remote from the bolt element (8; 118; 218) and the bolt element (18; 118; 218) are supported at said U section (17) of the force cell (16).

3. A hoop lock in accordance with claim 1 characterized in that at least one for cell (16) has walls (36) formed as drill protection and/or blow protection, which at least partly bound a protected space for at least the hoop end (14) and the bolt element (18; 118; 218).

4. A hoop lock in accordance with claim 1, characterized in that the locking unit (22) is arranged between the force cells (16), with the two force cell (16) being fastened at the locking unit (22), at a reception housing (24) for the being unit (22).

5. A hoop lock in accordance with claim 1, characterized in that said actuating member (26, 226) extending between the locking unit (22) and the latching arrangement (18, 20; 118, 120; 218) is provided for the actuation of at least one latching arrangement (18, 20; 118, 120; 218) with a rotary movement of the locking unit (22) that causes an actuation movement of the actuating member (26; 226) substantially parallel to its longitudinal axis and substantially perpendicular to the axis of rotation of the locking unit (22).

6. A hoop lock in accordance with claim 5, further characterized in that a positioning element (20; 120) is operative to be moved by the actuating member (26; 226) via an actuating pin (52) that extends perpendicular to the direction in which the actuating member moves.

7. A hoop lock in accordance with claim 1, characterized in that the bolt element (18; 118; 218) has a convex curvature at least in a region cooperating with the inserted hoop end (14) and is formed as a cylinder or spherical section.

8. A hoop lock in accordance with claim 1, characterized in that the bolt element (18; 118; 218) is operative to be moved out of a latched position in the released state by pulling the hoop end (14) out of the force cell (16).

9. A hoop lock in accordance with claim 1, characterized in that the bolt element (18; 118; 218) is operative to be moved out of a latched position against a resetting force of a spring member (30; 130) arranged in or projecting into the force cell (16), with the resetting force being dimensioned such that the inserted hoop 12) is held at the lock body (10) secure against falling out.

10. A hoop lock in accordance with claim 1, characterized in that the force cells (16) and the locking unit (22) are arranged inside a housing (28) of the lock body (10) which is made of metal and which is formed in a tube shape.

11. A hoop lock in accordance with claim 1, characterized in that at least one latching arrangement (18, 20; 118; 120) is made in multiple parts and the bolt element (18; 118) is supported indirectly at the force cell (16) via a positioning element (20; 120) which can be actuated via the locking unit (22).

12. A hoop lock in accordance with claim 11, characterized in that the bolt element (18) is formed in the shape of a roller or a ball.

13. A hoop lock in accordance with claim 11 characterized in that the positioning element is formed as an actuating arm (33) and a pivoted lever (20) having a support arm (34).

14. A hoop lock in accordance with claim 11, characterized in that the latching arrangement (18, 20) is made self-locking by a dead travel and/or a play of th positioning element (20).

15. A hoop lock in accordance with claim 14, characterized in that the positioning element (20) is operative to be moved further beyond a maximum latched position which an be set with the locking unit (22), with the bolt element (18) being supported at the force cell (16) via the positioning element (20) in each additional position.

16. A hoop lock in accordance with claim 14, characterized in that the positioning element (20) is operative to be brought into engagement with th bolt element (18) and operative to be clamped or wedged between the bolt element (18) and the force cell (16) by pivotal movement beyond a maximum latched position that can be set.

17. A hoop lock in accordance with claim 11, characterized in that at least one force cell (16) is provided at opposite walls (36) with apertures (37) which each have a reception region (37*a*) for the bolt element (18) and a support region (37*b*) substantially opposite the reception region (37*a*) for the positioning element (20).

18. A hoop lock in accordance with claim 11, characterized in that a spring tongue (30) operative to be deflected by movement of the bolt element (18) provided as a spring member for the bolt element (18) and is connected to a plate-s aped carrier arranged outside the force cell (16) adjoining an outer wall of the force cell (16).

19. A hoop lock in accordance with claim 11, characterized in that the positioning element (20) is held in a support region (37*b*) by a holding member (1) arranged in or projecting into the force cell (16), with the holding member (31) being connected to a carrier (32) arranged outside the force cell (16).

20. A hoop lock in accordance with claim 11, characterized in that the bolt element (118) is formed in an approximately U shape and whose open side faces the other force cell (16), with a spring member (130) for the bolt element (118) being arranged between its U limbs (118*a*).

21. A hoop lock in accordance with claim 20, characterized in that the positioning element (120) can be adjusted, and displaced, in a plane extending approximately perpendicular to the U limbs (118*a*) of the bolt element (118).

22. A hoop lock in accordance with claim 20, characterized in that at least one U limb (118*a*) blocked in the latched state by the positioning element (120) can be moved past the positioning element (120) in the released state or can be moved through a recess (120*a*) in the positioning element (120).

23. A hoop lock in accordance with claim 1, characterized in that at least one latching arrangement is formed in one part as a bolt element (218) which both cooperates with the inserted hoop end (14) and can be actuated via the locking unit (22), which is directly supported at the force cell (16) and whose adjusting movement is a pivotal movement.

24. A hoop lock in accordance with claim 23, characterized in that the bolt element (218) is blocked by at least one support section (217*a*) of the force cell (16) in the latched state and can be moved past the support section (217*a*) in the released state.

25. A hoop lock in accordance with claim 23 characterized in that the bolt element (218) has, at its side remote from the inserted hoop end (14), an actuating arm (233) and a support arm (234) which is of fork shape and which cooperates with opposite support sections (217*a*) of the force cell (16), with the actuating arm (233) and the sup ort arm (234) forming an angle other than zero of less than 90°.

26. A hoop lock comprising:

a lock body; and a hoop having hoop ends, said hoop couples at said hoop ends to the lock body and latches thereto in a coupled state wherein two force cells being spatially separated from one another are arranged in the lock body for the insertion of the hoop ends and each force cell is associated with a latching arrangement for one of each hoop ends, said latching arrangement being adjustable between a latched state and a released state and operative to be actuated via a locking unit, and wherein at least one latching arrangement communicates with a bolt element that is separate from said at least one latching arrangement, said bolt element being movably held at the force cell wherein the force cell is spatially separated from the locking unit, said at least one latching arrangement, includes with a pivoted lever that is operative to be actuated about an axis that is transverse to an insertion direction of the hoop ends when said latching arrangement is adjusted between said latched state and said released state, and wherein at least one force cell has a U section whose open side faces the other cell, and wherein the inserted hoop end is supported at a U base of said U section and the bolt element is supported by at least one U limb of said U section.

* * * * *